US007556232B1

(12) United States Patent
Begg

(10) Patent No.: US 7,556,232 B1
(45) Date of Patent: Jul. 7, 2009

(54) LOCKING DISPLAY DEVICE FOR EYEGLASSES

(75) Inventor: Robert G. Begg, Maple Ridge (CA)

(73) Assignee: 20/20 Marketing Ltd., Maple Ridge (CA)

( * ) Notice: Subject to any disclaimer, the term of this patent is extended or adjusted under 35 U.S.C. 154(b) by 0 days.

(21) Appl. No.: 12/028,769

(22) Filed: Feb. 8, 2008

(51) Int. Cl.
*A47G 1/10* (2006.01)

(52) U.S. Cl. ..... 248/316.7; 248/902; 248/229.16; 248/74.1; 248/74.4; 248/316.6; 248/313; 24/3.12; 24/3.3; 24/3.8; 351/112; 351/155

(58) Field of Classification Search ..... 248/316.7, 248/902, 229.16, 74.1, 74.4, 316.6, 313; 24/3.12, 3.3, 3.8; 351/112, 155
See application file for complete search history.

(56) References Cited

U.S. PATENT DOCUMENTS

| | | | | |
|---|---|---|---|---|
| 2,766,500 | A * | 10/1956 | Chanko | 24/332 |
| 2,766,657 | A * | 10/1956 | Nathan | 351/111 |
| 5,176,262 | A | 1/1993 | Zoueki | |
| 5,711,417 | A * | 1/1998 | Tilve | 206/6 |
| 5,826,271 | A * | 10/1998 | Garrett | 2/10 |
| 5,941,487 | A * | 8/1999 | Keely | 248/231.51 |
| 5,988,577 | A * | 11/1999 | Phillips et al. | 248/231.81 |
| 6,168,273 | B1 * | 1/2001 | Dupraz et al. | 351/158 |
| 6,210,003 | B1 * | 4/2001 | Chan | 351/112 |
| 6,364,124 | B1 | 4/2002 | Chen | |
| 6,564,432 | B1 * | 5/2003 | Kushner | 24/3.3 |
| 6,598,268 | B1 * | 7/2003 | Zelman | 24/3.3 |
| 6,644,608 | B1 | 11/2003 | Begg | |
| 6,691,374 | B2 * | 2/2004 | Coyne | 24/3.3 |
| 6,728,995 | B2 * | 5/2004 | Ainley et al. | 24/3.3 |
| 6,752,299 | B2 * | 6/2004 | Shetler et al. | 224/197 |
| 6,938,304 | B2 * | 9/2005 | Chen | 24/3.12 |
| 6,955,279 | B1 * | 10/2005 | Mudd et al. | 224/197 |
| 6,962,315 | B2 * | 11/2005 | Lee et al. | 248/316.1 |
| 7,174,575 | B1 * | 2/2007 | Scherer | 2/418 |
| 7,331,554 | B2 * | 2/2008 | Cheng | 248/316.7 |
| 2002/0010983 | A1 * | 1/2002 | Lee | 24/3.12 |
| 2002/0083558 | A1 * | 7/2002 | Tsou | 24/3.12 |

FOREIGN PATENT DOCUMENTS

| | | | |
|---|---|---|---|
| EP | 1255009 | A1 | 11/2002 |
| WO | 96/23123 | A1 | 8/2006 |

* cited by examiner

*Primary Examiner*—J. Allen Shriver, II
*Assistant Examiner*—Nkeisha J Smith
(74) *Attorney, Agent, or Firm*—Oyen Wiggs Green & Mutala LLP

(57) ABSTRACT

An apparatus for securely displaying a pair of eyeglasses comprising a mounting member adapted to be securely attached to a display fixture, a base member coupled to the mounting member having a first end and a second end, and, a cap member having a first end and a second end. The base member and the cap member are pivotally coupled together near the first ends thereof such that the apparatus is moveable between an open configuration wherein the second ends of the cap member and the base member are spaced apart from each other and a closed configuration wherein the second ends of the cap member and the base member are in close proximity to each other. The second ends of the cap member and the base member have corresponding releasably locking features thereon configured to releasably lock the apparatus in the closed configuration. The cap member and the base member are configured to securely retain either a bridge portion or both temple pieces of a pair of eyeglasses therebetween when the apparatus is in the closed configuration.

11 Claims, 7 Drawing Sheets

LOCKING DISPLAY DEVICE FOR EYEGLASSES

FIELD OF THE INVENTION

This invention relates to display devices for eyeglasses. In particular, the invention relates to a lockable clip for securely displaying eyeglasses.

BACKGROUND OF THE INVENTION

A number of devices for displaying eyewear in commercial operations are known. Conventional devices may include racks or stands on which eyeglasses may be placed. However, such stands are typically limited to displaying the eyeglasses in a single orientation. Further, such stands typically lack any means for locking the eyeglasses to the stand, so that displayed merchandise is vulnerable to theft.

U.S. Pat. No. 5,176,262 to Zouéki discloses a display apparatus comprising a heavy base, a main stem pivotally fused to the base, and a tip element and sliding elements attached to the main stem. The tip and sliding elements include another pivotable stem and a vise to attach the eyeglasses. Screws are used to apply friction to the surfaces of the stems to keep them in any desired orientation while allowing the stems to be turned without a tool.

U.S. Pat. No. 6,364,124 to Chen discloses a locking display stand including a display panel. A lock hook extends from the outer face of the display panel, the lock hook being rotatable to mate its outer end with the outer end of a rack so as to lock a displayed article bridged over the rack. A lock latch transversely rides on a slide channel of the lock seat, and a solenoid-controlled valve is fixedly mounted on the lock seat to control abutment of the lock latch against the lock hook in either a locked or unlocked position.

Patent application publication No. WO 96/23123 to Leyden et al. discloses a security apparatus for attachment to at least a portion of a portable article. A base member and a cap member securely clamp at least a portion of the portable article when the cap member is in its substantially closed position. A rack and pawl, associated with the base and cap members, releasably and adjustably lock the cap member in its substantially closed position. The placement of an appropriate magnetic field proximate the apparatus unlocks the cap member from the base member.

European Patent Application No. 1,255,009 to Lorenz discloses an antitheft tag to be applied to the temple of glasses which comprises a boxed body applied to the outer part of the temple and fixed through a bridge housing, against which the temple itself is locked through a threaded clamp. The outer wall of the body includes a slit, which constitutes the keyhole of a lock in which a key is slotted to lock the body to the temple.

The inventor has identified a need for improved devices for securely displaying eyeglasses.

SUMMARY OF THE INVENTION

One aspect of the invention provides an apparatus for securely displaying a pair of eyeglasses comprising a mounting member adapted to be securely attached to a display fixture, a base member coupled to the mounting member having a first end and a second end, and, a cap member having a first end and a second end. The base member and the cap member are pivotally coupled together near the first ends thereof such that the apparatus is moveable between an open configuration wherein the second ends of the cap member and the base member are spaced apart from each other and a closed configuration wherein the second ends of the cap member and the base member are in close proximity to each other. The second ends of the cap member and the base member have corresponding releasably locking features thereon configured to releasably lock the apparatus in the closed configuration. The cap member and the base member are configured to securely retain either a bridge portion or both temple pieces of a pair of eyeglasses therebetween when the apparatus is in the closed configuration.

Further aspects of the invention and details of example embodiments are described below.

BRIEF DESCRIPTION OF DRAWINGS

In drawings which show non-limiting embodiments of the invention.

DETAILED DESCRIPTION OF THE INVENTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
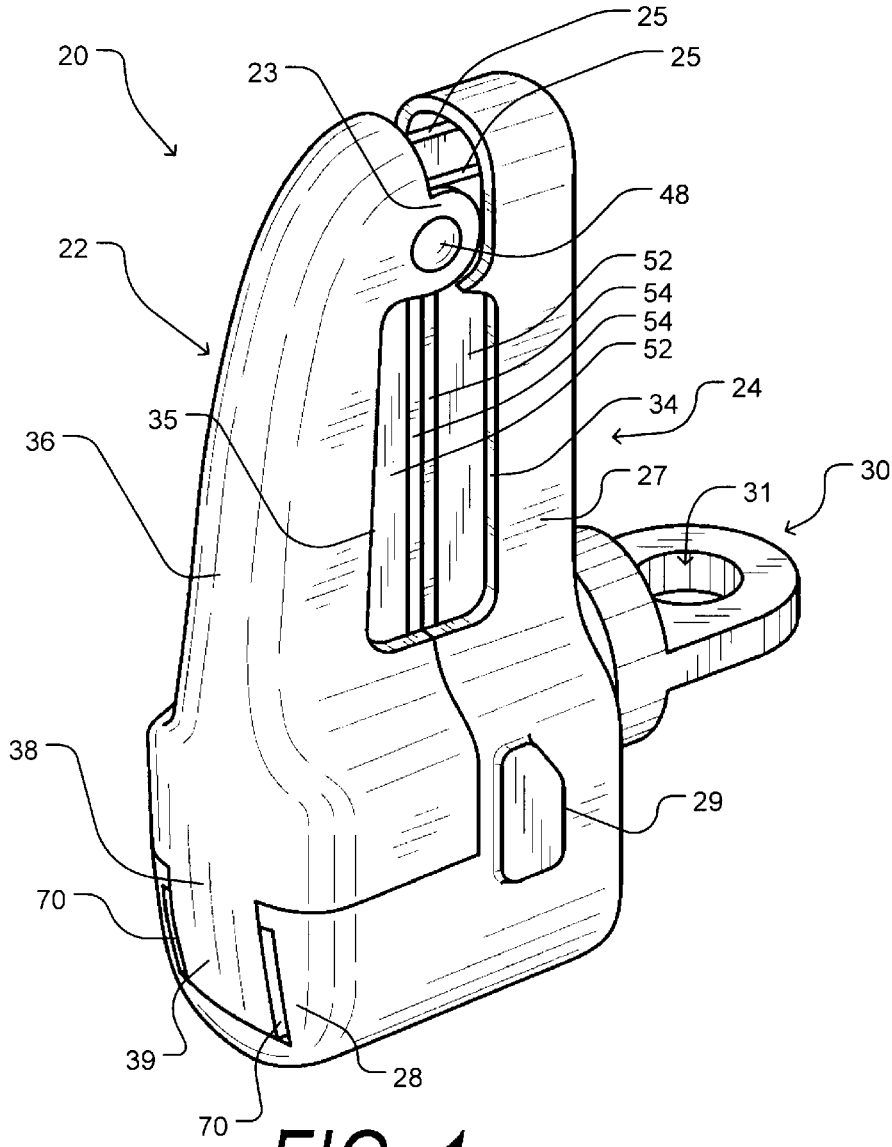
FIG. 1 is a perspective view of a locking display apparatus according to an embodiment of the invention.
Figure 2:
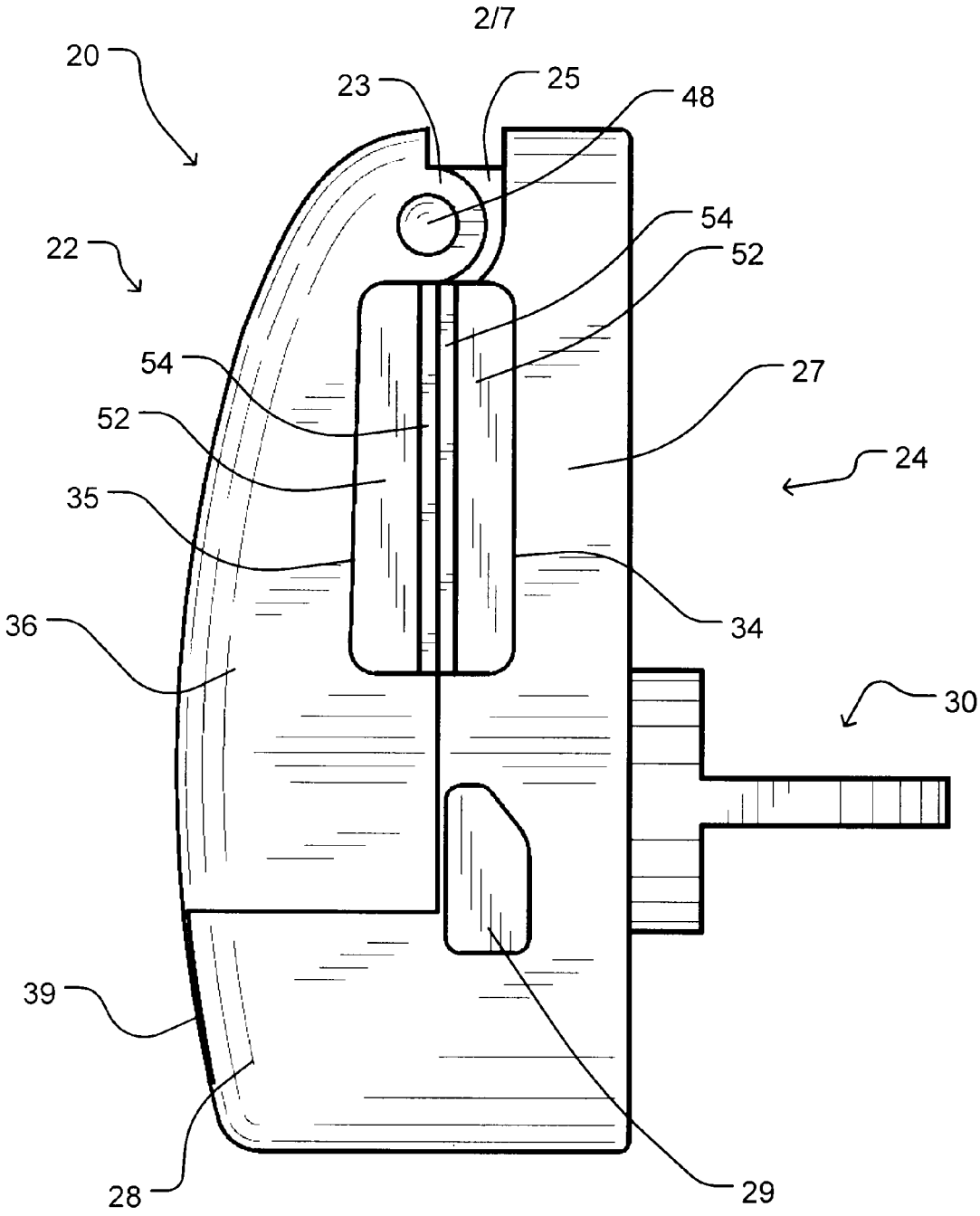
FIG. 2 is a right side view of the apparatus of FIG. 1.
Figure 3:
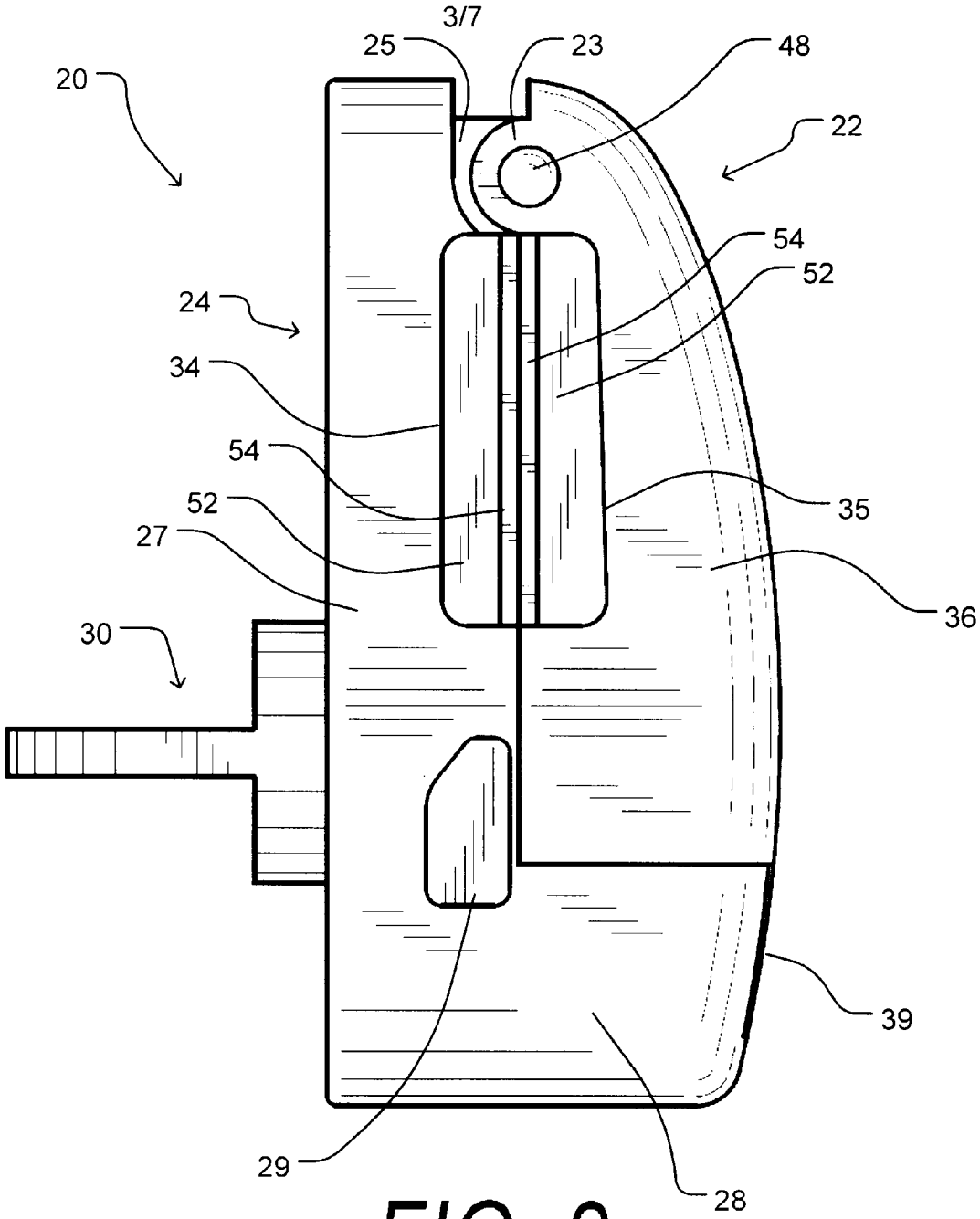
FIG. 3 is a left side view of the apparatus of FIG. 1.
Figure 4:
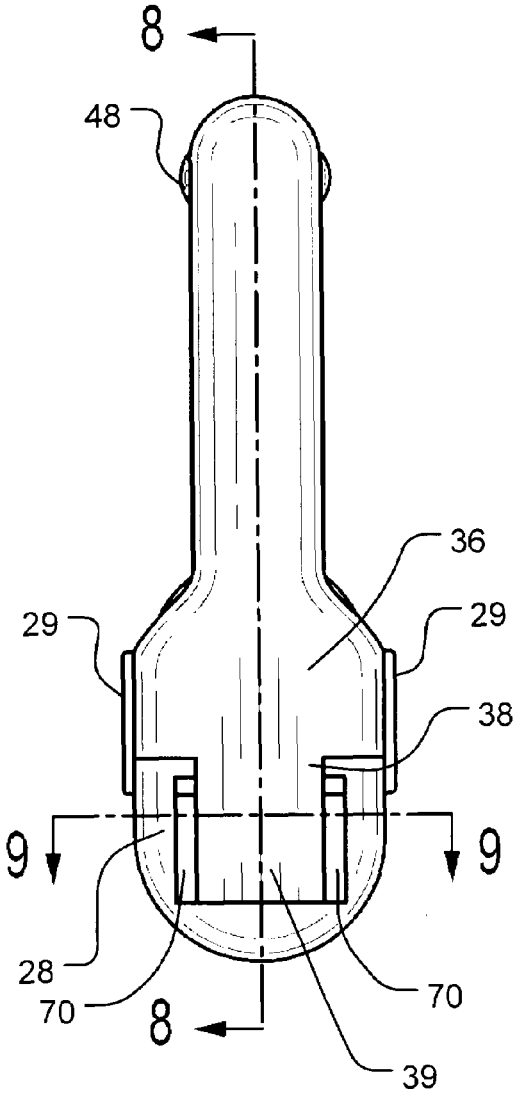
FIG. 4 is a front view of the apparatus of FIG. 1.
Figure 5:
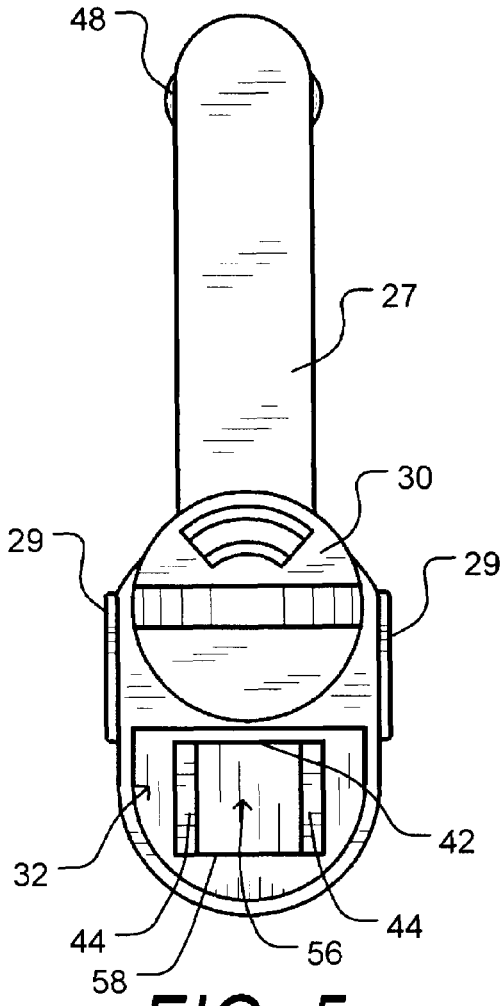
FIG. 5 is a back view of the apparatus of FIG. 1.
Figure 6:
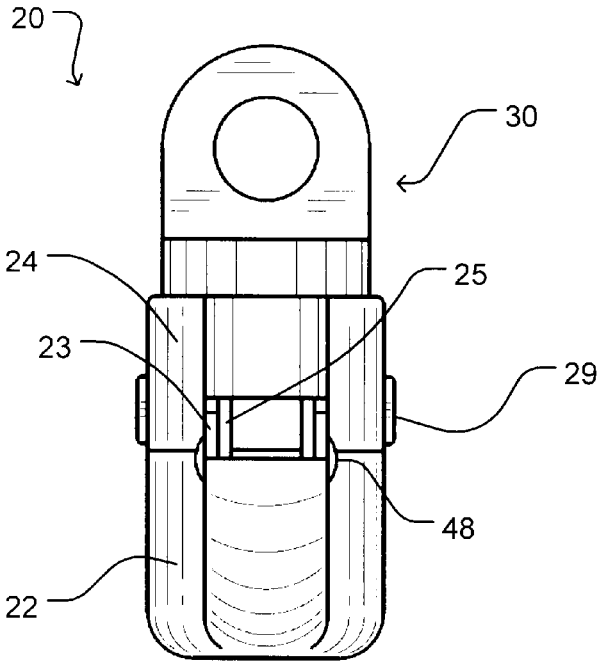
FIG. 6 is a top view of the apparatus of FIG. 1.
Figure 7:
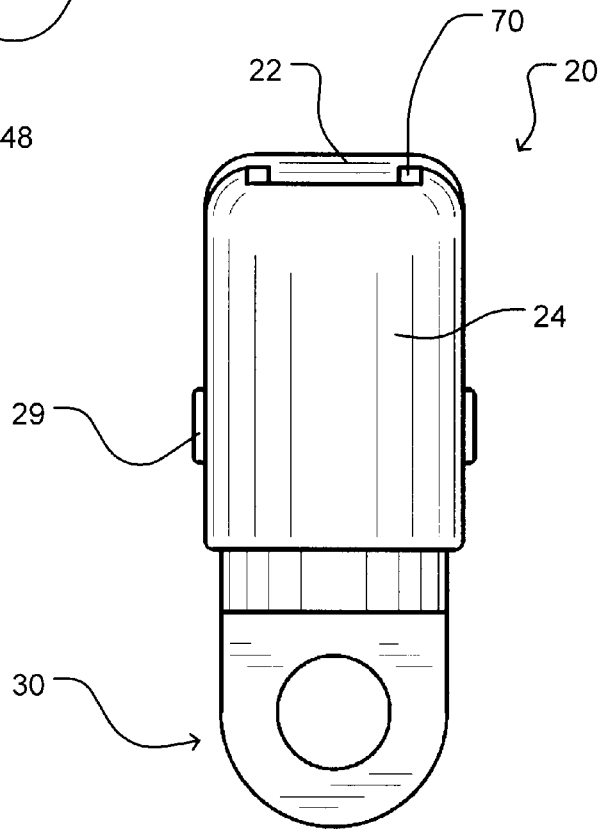
FIG. 7 is a bottom view of the apparatus of FIG. 1.
Figure 8:
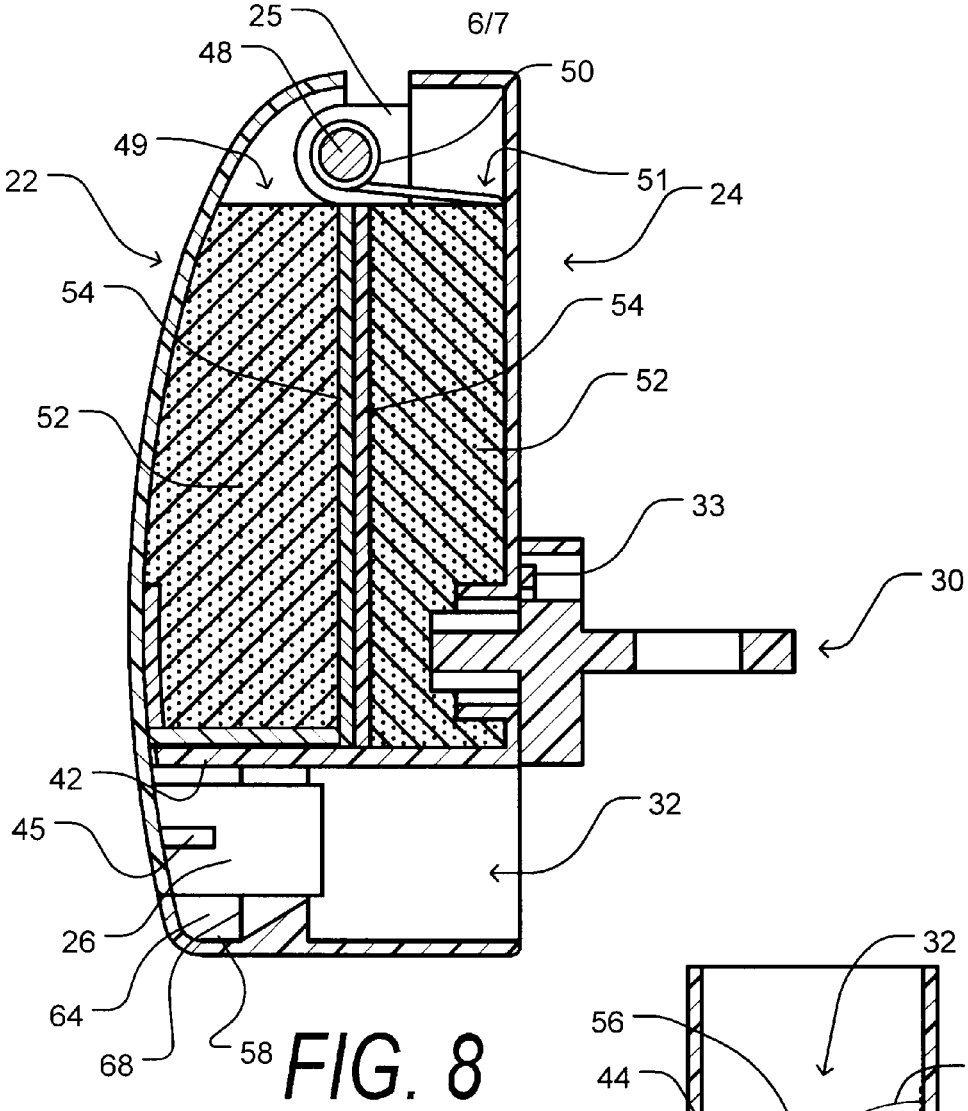
FIG. 8 is a sectional view taken along line 8-8 of FIG. 4.
Figure 9:
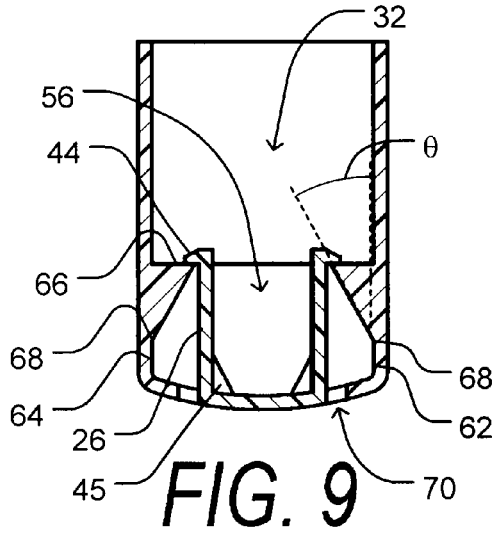
FIG. 9 is a sectional view taken along line 9-9 of FIG. 4.
Figure 10:
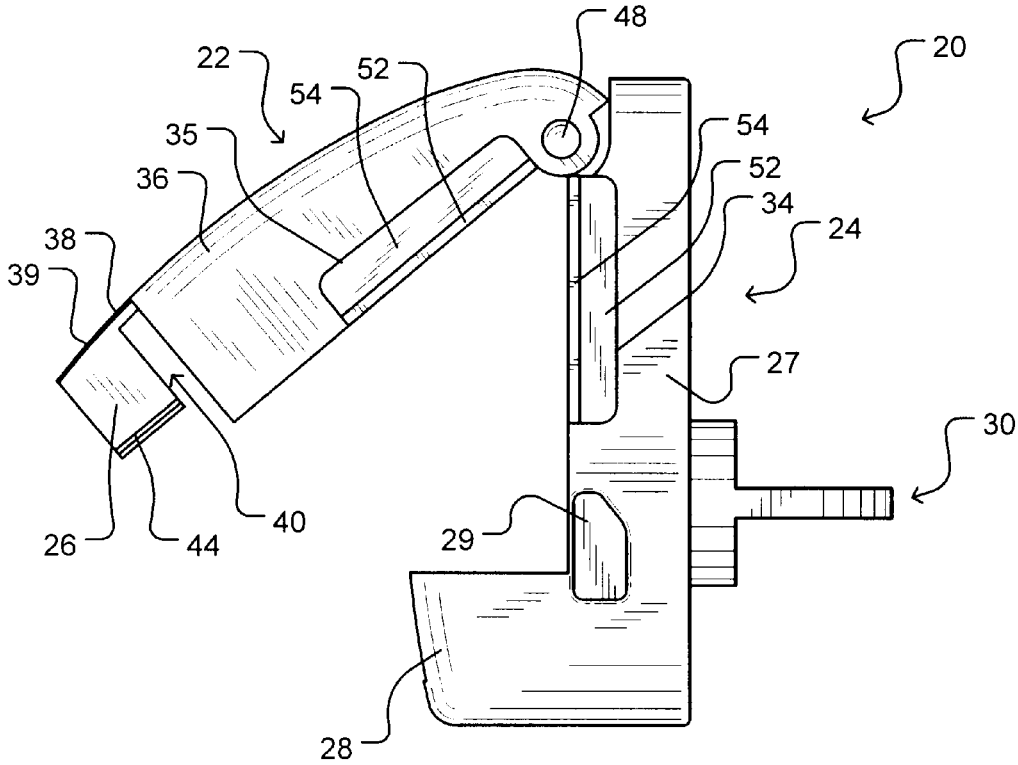
FIG. 10 is a right side view of the apparatus of FIG. 1 in an open configuration.

FIGS. 1 through 10 illustrate a display apparatus 20 according to one embodiment of the present invention. Apparatus 20 comprises a cap member 22 and a base member 24. Cap member 22 is moveable with respect to base member 24 between a closed position as shown in FIG. 1, and an open position as shown in FIG. 10.

A pair of eyeglasses may be securely displayed by first placing apparatus 20 in the open position, inserting the eyeglasses between cap member 22 and base member 24, and pressing cap member 22 and base member 24 together such that display clamp 20 is placed in the closed position. In the illustrated embodiment, apparatus 20 is configured to engage either the bridge or the temple pieces of a pair of eyeglasses, as discussed below. This allows users of apparatus 20 flexibility in arranging eyeglasses for display.

Cap member 22 is pivotally coupled to base member 24 in some embodiments. Each of cap member 22 and base member 24 has a first end and a second end. In the illustrated embodiment, cap member 22 and base member 24 respectively comprise hinge mounts 23 and 25 near first ends thereof. Cap member 22 and base member 24 are pivotally coupled together by a pin 48 extending through apertures defined in hinge mounts 23 and 25. Alternatively, cap member 22 and base member 24 may be connected by a thin flexible web of material (such as, for example plastic), sometimes referred to as a "living hinge". A spring 50 (see FIG. 8) may be positioned about pin 48 for biasing cap member 22 toward the open configuration shown in FIG. 10. In the illustrated embodiment, spring 50 is positioned about pin 48, but as are skilled in the art will appreciate, other arrangements are also possible.

Cap member 22 and base member 24 may comprise corresponding releasably locking features located at or near second ends thereof. In the illustrated embodiment, cap member 22 comprises locking arms 26 (see FIGS. 8-10), and base member 24 comprises a locking receptacle 28. As discussed below, locking arms 26 are adapted to be slidably received in locking receptacle 28, such that when apparatus 20 is in the closed position locking arms 26 are prevented from being removed from locking receptacle 28 without the use of a suitable opening device, such as for example opening device 72 shown in FIGS. 11 and 12.

A mounting member 30 is coupled to base member 24. Mounting member 30 may be located on the side of base member 24 opposite cap member 22. Mounting member 30 facilitates secure attachment of apparatus 20 to a display fixture such as a rod, wall, shelf, counter, or the like. In the illustrated embodiment, mounting member 30 comprises an aperture 31 defined therein, which facilitates sliding attachment of apparatus 20 to a rod, post or other elongated member. As one skilled in the art will appreciate, mounting member 30 may take different forms in other embodiments to facilitate attachment of apparatus 20 to other types of display fixtures.

Mounting member 30 may be rotatably coupled to base member 24, which permits apparatus 20 to be rotated while remaining securely attached to the display fixture. Mounting member 30 may include a ratchet mechanism 33 (see FIG. 8) that permits apparatus 20 to be held at one of a plurality of predetermined angles with respect to mounting member 30. The predetermined angles may be in increments of 30°, for example, although other increments may be used. The predetermined angles provided by the ratchet mechanism allow the angles at which the eyeglasses are displayed to be quickly and easily altered by the user, and ensure consistency in the angles at which the eyeglasses are placed. When a plurality of apparatuses 20 are affixed to one or more display fixture(s), eyeglasses held by apparatuses 20 may be easily positioned to give a positive aesthetic appearance, either all at the same angles, or at different angles to provide a unique visual display.

As best seen in FIGS. 8-10, cap member 22 comprises hinge mounts 23 at a first end thereof and locking arms 26 at a second end thereof. Locking arms 26 extend inwardly from a tip 39 of cap member 22. Tip 39 is separated from a main body 36 of cap member 22 by a joining region 38, such that a space 40 is defined between main body 36 of cap member 22 and locking arms 26. Space 40 permits locking arms 26 to slide into an space 56 defined in locking receptacle 28 when display clamp 20 is in the locked configuration. Space 40 is sized to accommodate a side 42 (see FIG. 5) of locking receptacle 28, which is received between locking arms 26 and the main body 36 of cap member 22 in the locked configuration.

Locking arms 26 are generally parallel to each other. Locking arms 26 comprise locking flanges 44. Locking flanges 44 protrude outwardly from locking arms 26. Locking arms 26 may further include reinforcing ridges 45 affixed to the inner surface of tip 39 to provide further support to locking arms 26.

In the illustrated embodiment, base member 24 comprises a main body 27, with hinge mounts 25 near a first end thereof and locking receptacle 28 near a second end thereof. A pair of protrusions 29 may extend from either side of main body 27. Protrusions 29 may be positioned to support nose pieces of a pair of eyeglasses which are secured in apparatus 20 by placing a bridge portion thereof between cap member 22 and base member 24.

Locking receptacle 28 defines a space 56 which is adapted to receive locking arms 26. In the illustrated embodiment, space 56 is rectangular in shape and bounded by sides 42, 58, 62, and 64. Side 58 of locking receptacle 28 is positioned opposite to side 42. Side 58 and side 42 of locking receptacle 28 are generally straight in configuration, and are generally parallel to each other. In the illustrated embodiment, side 42 defines an indentation (not shown) on the edge of side 42 farthest from main body 27 of base member 24. This indentation is formed so as to receive joining region 38 of cap member 22, thereby allowing the outer surface of cap member 22 to sit flush with the outer edges of locking receptacle 28 when apparatus 20 is in the closed configuration. However, it is not necessary that the outer surface of cap member 22 sit flush with the outer edges of locking receptacle 28 in all embodiments.

With reference to FIG. 9, remaining opposing sides 62 and 64 of locking receptacle 28 are configured so as to receive locking arms 26, and so as to allow locking flanges 44 to enter space 32 when apparatus 20 is in the locked configuration. Space 32 is larger than space 56 to accommodate locking flanges 44. In the locked configuration of display clamp 20, locking flanges 44 abut against locking edges 66 located at the base of sides 62 and 64, thereby maintaining cap 22 in the closed position despite the biasing force applied by spring 50.

To achieve this locking function, the surfaces of sides 62 and 64 are angled slightly in towards the centre of space 56, such that the portion of space 56 closest to main body 27 of base member 24 is more narrow than the portion of space 56 farthest from main body 27. In some embodiments, sides 62 and 64 may be generally straight to approximately a midpoint 68 of sides 62 and 64, and then sides 62 and 64 may slope gradually inwards to the base of locking receptacle 28 to form locking edges 66. Such an arrangement will force the ends of locking arms 26 together as they enter space 56, and allow locking arms 26 to return to their parallel orientation once flanges 44 have passed locking edges 66.

Sides 62 and 64 may slope inwards at an angle θ. Angle θ may be, for example, in the range of 5° to 30°. However, as will be apparent to those skilled in the art, sides 62 and 64 could slope at other angles, and sides 62 and 64 need not slope inwards into space 56 beginning at their midpoint. All that is required is that sides 62 and 64 are configured so that locking arms 26 may slide smoothly down sides 62 and 64, and so that locking edges 66 are adequately provided to engage locking flanges 44.

In the illustrated embodiment, main body 36, hinge mounts 23, joining region 38, tip 39, locking arms 26, reinforcing ridges 45, and locking flanges 44 of cap member 22 are integrally formed. In other embodiments, cap member 22 may comprise two or more elements which have been joined together. Likewise, main body 27, hinge mounts 25, locking receptacle 28 and protrusions 29 of base member 24 may be integrally formed or comprise two or more elements which have been joined together. Cap member 22 and base member 24 may be made, for example, of injection molded plastic.

As shown in FIG. 8, cap member 22 and base member 24 define interior cavities 49 and 51 which are filled with a compressible layer 52 in the illustrated embodiment. A resilient layer 54 may be provided along the edge of each of compressible layers 52. Compressible layers 52 may comprise, for example, foam or the like. Resilient layers 54 may be made from a firm material to compress compressible layers 52 when eyeglasses are secured in apparatus 20. Each resilient layer 54 is preferably made from a material that will not scratch or dent the eyeglasses, and may be made from, for example, hard rubber. Main body 27 of base member 24 and main body 36 of cap member 22 respectively define cut-out portions 34 and 35 sized to accommodate portions of eyeglasses held by apparatus 20.

Cut-out portions 34 and 35 are preferably sized to accommodate either a bridge portion of a pair of eyeglasses, or both temple pieces of a pair of eyeglasses. The sizes and shapes of cut-out portions 34 and 35 may vary to accommodate different types of glasses. For example, cut-out portions 34 and 35 may be small enough in some embodiments to prevent thin-framed glasses from being removed from apparatus 20 when apparatus 20 is in the closed position by compressing compressible layers 52.

To secure a pair of eyeglasses in apparatus 20, either the bridge of the eyeglasses or both temple-pieces of the eyeglasses may be placed between resilient layers 54 on both cap member 22 and base member 24. Pressing cap member 22 securely against base member 24 forces locking flanges 44 of locking arms 26 into the locked position, abutting locking edges 66. In the locked configuration, opening spaces 70 are defined between locking arms 34 and sides 62 and 64 of locking receptacle 28. In this configuration, display clamp 20 firmly holds the eyeglasses in the position in which they have been placed. Because of the secure fit of locking flanges 44 against locking edges 66, display clamp 20 may not be opened without the assistance of an opening device such as, for example, opening device 72, thereby protecting the eyeglasses from theft.

Figure 11:
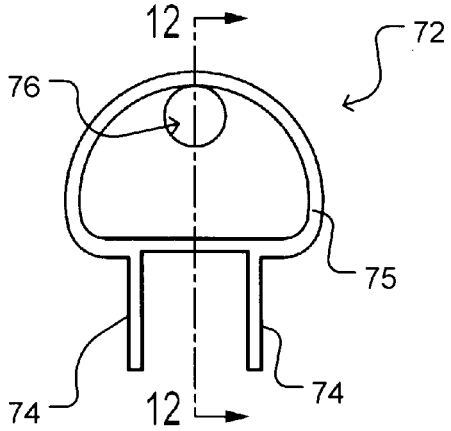
FIG. 11 is a front view of an opening device according to an embodiment of the invention.
Figure 12:
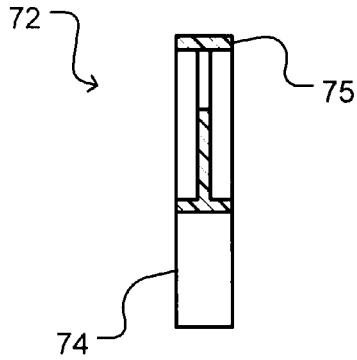
FIG. 12 is a sectional view taken along line 12-12 of FIG. 11.

With reference to FIGS. 11 and 12, opening device 72 includes unlocking arms 74. Unlocking arms 74 are generally parallel arms adapted to fit into opening spaces 70 when display clamp 20 is in the closed configuration. Unlocking arms 74 are spaced sufficiently apart so that one of unlocking arms 74 can be fit into each of opening spaces 70 of display clamp 20 at the same time. Unlocking arms 74 protrude generally orthogonal to a base 75 of opening device 72. Unlocking arms 74 may be resiliently flexible, and opening device 72 may be formed, for example, from hard plastic. In the illustrated embodiment, base 75 of opening device 72 is formed in the shape of a half-circle. Additionally, the base 75 of opening device 72 may include a hole 76, to enable opening device 72 to be affixed to a key chain or other similar device to ensure it is not easily lost. However, other configurations and shapes of opening device 72 may also be employed, so long as unlocking arms 74 are configured so as to be easily inserted into opening spaces 70.

To unlock apparatus 20, unlocking arms 74 are inserted into opening spaces 70 until the tips of unlocking arms 74 force locking arms 26 inwardly such that locking flanges 44 are disengaged from locking edges 66. Once locking flanges 44 have been disengaged from locking edges 66, the biasing force applied by spring 50 causes cap member 22 to pivot away from base member 24. Opening arms 74 may then be removed from opening spaces 70 so that cap member 22 may be easily moved into the open configuration to allow for the insertion or removal of the eyeglasses. After the eyeglasses have been inserted, apparatus 20 may again be placed in the locked configuration by pressing cap member 22 together with base member 24 until locking flanges 44 have engaged locking edges 66.

As will be apparent to those skilled in the art in the light of the foregoing disclosure, many alterations and modifications are possible in the practice of this invention without departing from the spirit or scope thereof. For example:

Although apparatus 20 has been described with reference to two generally parallel locking arms 26, other configurations are possible. For example, apparatus 20 may include only one locking arm 26, and locking receptacle 28 may correspondingly includes only one locking edge 66 positioned so as to receive locking arm 26. Other configurations of locking arms 26 and locking edges 66 may also be used without departing from the scope of the invention.

Additionally, while the use of apparatus 20 has been described with reference to eyeglasses, it will be apparent that other small articles such as jewelry, purses, watches and the like can be similarly securely displayed using apparatus 20.

It is therefore intended that the following appended claims and claims hereafter introduced are interpreted to include all such modifications, permutations, additions and sub-combinations as are within their true spirit and scope.

The invention claimed is:

1. An apparatus for securely displaying a pair of eyeglasses, the apparatus comprising:

a mounting member adapted to be securely attached to a display fixture;

a base member coupled to the mounting member, the base member having a first end and a second end;

a cap member having a first end and a second end, the cap member and the base member being pivotally coupled together near the first ends thereof such that the apparatus is moveable between an open configuration wherein the second ends of the cap member and the base member are spaced apart from each other and a closed configuration wherein the second ends of the cap member and the base member are in close proximity to each other, the second ends of the cap member and the base member having corresponding releasably locking features thereon configured to releasably lock the apparatus in the closed configuration, the corresponding releasably locking features comprising one or more opening spaces such that the apparatus is only releasable from the closed configuration by inserting an opening device into the one or more opening spaces, whereby the cap member and the base member are configured to securely retain one of a bridge portion and a pair of temple pieces of a pair of eyeglasses therebetween in the closed configuration;

wherein the base member is rotatably coupled to the mounting member; and, wherein the mounting member comprises a ratchet mechanism configured to hold the base member in one of a plurality of predetermined angular relationships.

2. An apparatus for securely displaying a pair of eyeglasses, the apparatus comprising:

a mounting member adapted to be securely attached to a display fixture;

a base member coupled to the mounting member, the base member having a first end and a second end;

a cap member having a first end and a second end, the cap member and the base member being pivotally coupled together near the first ends thereof such that the apparatus is moveable between an open configuration wherein the second ends of the cap member and the base member are spaced apart from each other and a closed configuration wherein the second ends of the cap member and the base member are in close proximity to each other, the second ends of the cap member and the base member having corresponding releasably locking features thereon configured to releasably lock the apparatus in the closed configuration, the corresponding releasably locking features comprising one or more opening spaces such that the apparatus is only releasable from the closed configuration by inserting an opening device into the one or more opening spaces, whereby the cap member and the base member are configured to securely retain one of a bridge portion and a pair of temple pieces of a pair of eyeglasses therebetween in the closed configuration;

wherein the corresponding releasably locking features comprise a locking receptacle in the second end of the base member and at least one locking arm extending from the second end of the cap member, the locking receptacle defining a space sized to receive the at least one locking arm; and, wherein the at least one locking arm comprises a pair of locking arms, each locking arm having a locking flange thereon extending away from the other locking arm.

3. An apparatus according to claim 2 wherein the locking receptacle has a pair of opposed sides which are angled toward a centre of the space defined by the locking receptacle, the pair of opposed sides defining locking edges configured to engage the locking flanges of the pair of locking arms when the apparatus is in the closed configuration such that the apparatus is locked in the closed configuration.

4. An apparatus according to claim 3 wherein an opening space is defined between each one of the pair of locking arms and a corresponding one of the pair of opposed sides of the locking receptacle when the apparatus is in the closed configuration, whereby the apparatus is moveable into the open configuration by inserting an unlocking arm of the opening device into each opening space.

5. An apparatus for securely displaying a pair of eyeglasses, the apparatus comprising:

a mounting member adapted to be securely attached to a display fixture;

a base member coupled to the mounting member, the base member having a first end and a second end;

a cap member having a first end and a second end, the cap member and the base member being pivotally coupled together near the first ends thereof such that the apparatus is moveable between an open configuration wherein the second ends of the cap member and the base member are spaced apart from each other and a closed configuration wherein the second ends of the cap member and the base member are in close proximity to each other, the second ends of the cap member and the base member having corresponding releasably locking features thereon configured to releasably lock the apparatus in the closed configuration, the corresponding releasably locking features comprising one or more opening spaces such that the apparatus is only releasable from the closed configuration by inserting an opening device into the one or more opening spaces, whereby the cap member and the base member are configured to securely retain one of a bridge portion and a pair of temple pieces of a pair of eyeglasses therebetween in the closed configuration; and, a spring configured to bias the apparatus into the open configuration.

6. An apparatus according to claim 5 wherein the spring is positioned about a pin which provides pivotal coupling between the cap member and the base member.

7. An apparatus for securely displaying a pair of eyeglasses, the apparatus comprising:

a mounting member adapted to be securely attached to a display fixture;

a base member coupled to the mounting member, the base member having a first end and a second end;

a cap member having a first end and a second end, the cap member and the base member being pivotally coupled together near the first ends thereof such that the apparatus is moveable between an open configuration wherein the second ends of the cap member and the base member are spaced apart from each other and a closed configuration wherein the second ends of the cap member and the base member are in close proximity to each other, the second ends of the cap member and the base member having corresponding releasably locking features thereon configured to releasably lock the apparatus in the closed configuration, the corresponding releasably locking features comprising one or more opening spaces such that the apparatus is only releasable from the closed configuration by inserting an opening device into the one or more opening spaces, whereby the cap member and the base member are configured to securely retain one of a bridge portion and a pair of temple pieces of a pair of eyeglasses therebetween in the closed configuration; and, wherein the cap member and the base member each define a cavity therein, the apparatus comprising a compressible layer in each of the cavities of the cap member and the base member.

8. An apparatus according to claim 7 comprising a resilient layer disposed on a surface of each compressible layer, the resilient layers made from a firm material such that the resilient layers compress the compressible layers when the pair of eyeglasses is secured in the apparatus.

9. An apparatus according to claim 8 wherein the cap member and the base member each define a cut-out portion, the cut-out portions sized to accommodate a portion of a pair of eyeglasses held between the resilient layers when the apparatus is in the closed configuration.

10. An apparatus according to claim 1 wherein the mounting member comprises an aperture defined therein to facilitate sliding attachment to an elongated member of the display fixture.

11. An apparatus for securely displaying a pair of eyeglasses, the apparatus comprising:

a mounting member adapted to be securely attached to a display fixture;

a base member coupled to the mounting member, the base member having a first end and a second end; and, a cap member having a first end and a second end, the cap member and the base member being pivotally coupled together near the first ends thereof such that the apparatus is moveable between an open configuration wherein the second ends of the cap member and the base member are spaced apart from each other and a closed configuration wherein the second ends of the cap member and the base member are in close proximity to each other, the second ends of the cap member and the base member having corresponding releasably locking features thereon configured to releasably lock the apparatus in the closed configuration, whereby the cap member and the base member are configured to securely retain one of a bridge portion and a pair of temple pieces of a pair of eyeglasses therebetween in the closed configuration, the corresponding releasably locking features comprising a locking receptacle in the second end of the base member and a pair of locking arms extending from the second end of the cap member, the locking receptacle defining a space sized to receive the pair of locking arms, each locking arm having a locking flange thereon extending away from the other locking arm, the locking receptacle having a pair of opposed sides which are angled toward a centre of the space defined by the locking receptacle, the pair of opposed sides defining locking edges configured to engage the locking flanges of the pair of locking arms when the apparatus is in the closed configuration such that the apparatus is locked in the closed configuration.

* * * * *